US005362213A

United States Patent [19]

Komatsu et al.

[11] Patent Number: 5,362,213

[45] Date of Patent: Nov. 8, 1994

[54] MICRO-PUMP AND METHOD FOR PRODUCTION THEREOF

[75] Inventors: Kiyoshi Komatsu; Takeshi Kudo; Takashi Kitamura; Ryo Tsukamoto, all of Kanagawa, Japan

[73] Assignee: Terumo Kabushiki Kaisha, Tokyo, Japan

[21] Appl. No.: 10,795

[22] Filed: Jan. 29, 1993

[30] Foreign Application Priority Data

Jan. 30, 1992 [JP] Japan ..... 4-15164

[51] Int. Cl.[5] ..... F04B 17/04

[52] U.S. Cl. ..... 417/418; 310/22

[58] Field of Search ..... 417/322, 418; 312/15, 312/17, 22

[56] References Cited

U.S. PATENT DOCUMENTS

| | | | |
|---|---|---|---|
| 1,572,126 | 2/1926 | Bothner | 417/418 |
| 1,783,611 | 12/1935 | Gohring | 417/418 |
| 1,804,375 | 5/1931 | Cobe | 417/418 |
| 2,578,902 | 12/1951 | Smith | 417/418 |
| 4,795,318 | 1/1988 | Cusack | 417/322 |
| 4,808,084 | 2/1989 | Tsubouchi et al. | 417/322 |
| 4,815,946 | 3/1989 | Cusack | 417/322 |

FOREIGN PATENT DOCUMENTS

| | | |
|---|---|---|
| 412270 | 2/1991 | European Pat. Off. . |
| 424087 | 4/1991 | European Pat. Off. . |

OTHER PUBLICATIONS

IEICE Technical Report, "Check Valve," vol. 89, No. 173, pp. 29–34 (Aug. 18, 1989).

Journal of the Institute of Electronics, Information and Communication Engineers (IEICE), "Fabrication of a Micro-Pump for Integrated Chemical Analysing Systems," C. vol. J71-C, No. 12, pp. 1705–1711 (Dec. 1988).

Technical Digest of the 10th Sensor Symposium, "Fabrication of Poly-Silicon Microvalve," Yamashita et al., pp. 29–32, 1991.

*Primary Examiner*—Richard E. Gluck

*Attorney, Agent, or Firm*—Burns, Doane, Swecker & Mathis

[57] ABSTRACT

A micro-pump having a cross-sectional area of not more than 5 mm$^2$ and usable as a drive source for the operation of a micro-machine and as the controlled flow of a fluid and a method for the production of this micro-pump are provided. The micro-pump is characterized by comprising a comb-shaped stationary electrodes, a fluid chamber, a piston formed in the fluid chamber, comb-shaped movable electrodes formed integrally with the piston, a conductive film for imparting a grounding potential to the piston and the comb-shaped movable electrodes, and check valves and consequently having a drive source integrally formed therein.

6 Claims, 8 Drawing Sheets

MICRO-PUMP AND METHOD FOR PRODUCTION THEREOF

BACKGROUND OF THE INVENTION

Field of the Invention

This invention relates to a micro-pump ant a method for the production thereof. More particularly, it relates to a micro-pump serving as a drive source for allowing mechanical motions of a work module body or a micro-machine and various actuators, sensors, etc. operating with module functions or a micro-pump for controlling the flow of an extremely small amount of fluid and to a method for the production of the micro-pump.

Description of the Prior Art

In recent years, diligent researches have been devoted to developing micro-machines to be used in the medical field and in various industrial fields. Functionally, micro-machines are machines of varying functions used generally in industrial fields such as nipping and lifting work module body and objects or fixing and moving various sensors. They have extremely small overall sizes falling approximately in the range of from 0.1 to 10 mm. They are not produced simply by miniaturizing various existing machines.

For the purpose of enabling micro-machines of this nature to produce a practical operation, drive sources of high reliability are indispensable. Numerous operating principles have been proposed for these micro-machines. They are intended to allow mechanical motions of the work module body or a micro-machine and various actuators, sensors, etc. operating with module functions. Depending on the kind of work, they are required to permit flow of fluids such as gas, water, and chemical solutions to suites of work. Further, they are possibly compelled to fix machine bodies or work units firmly in place in certain work environments.

A review of such drive sources prevailing over a wide range of industrial fields reveals the fact that a great many of them make use of jacks and lifts which operate hydraulically. The reason for their popular use is that they are able to generate a large Dower with a relatively simple construction and they are durable and reliable. Particularly in situations where speed does not account for much but reliable supply of a large drive force is an essential requirement, methods which utilize the pressure of a fluid are effective. When the use of a fluid in this manner is contemplated as a drive source for a micro-machine, the drive source requires a pump which discharges and aspirates the fluid.

Among the conventional micro-pumps whose operations have found popular approval to date is that which is disclosed in the artiste titled "*Journal of the Institute of Electronics, Information and Communications Engineers (IEICE) C* Vol. J71-C, No. 12, pp. 1705–1711 (Dec. 1988).

This micro-pump 101 is manufactured by the application of the micro-machining technique. As illustrated in FIG. 11, it comprises a pump body having joined face to face a silicon substrate 103*a* forming two check valves 102*a* and 102*b* and a silicon substrate 103*b* forming a pressure chamber 104, a movable diaphragm 105, and a mesa 106 and a laminated piezo actuator 107 (2 mm×3 mm×9 mm) fixed on the Mesa 106 of the pump body. A voltage signal 108 applied to the actuator 107 causes the actuator 107 to generate a force which gives a push to the mesa 106 and deforms the diaphragm 105. At this time, the cheek valve 102*a* is shut and the cheek valve 102*b* is opened to introduce the fluid through an inlet 109 and discharge it through an outlet 110.

In terms of the operating principle, the conventional micro-pump described above is a positive-displacement type diaphragm pump which is one of the types of general-purpose industry grade pumps. It approximately measures 10 mm×10 mm×8 mm. Thus, it is hardly proper to conclude that this conventional micro-pump realizes an ideal micro-pump which is expected to possess a cross-sectional area in the range of from 1 to 5 $mm^2$ and an overall size of about 1 mm×2 mm×4 mm to suit use with a micro-machine.

When the operating principle of the general-purpose industrial pump is directly applied to the micro-pump, the miniaturization of the mechanical part thereof entails the problem of proportionally increasing the viscous drag of the fluid and the frictional resistance of the sliding parts. The drive source which is sufficiently small in volume and is capable of generating a force large enough to drive (deform) a diaphragm yet remains to be developed.

An object of this invention, therefore, is to provide an extremely small micro-pump which has an overall size of about 1 mm×2 mm×4 mm and can be advantageously used as a drive source for operating a micro-machine and permitting effective flow of the fluid for the micro-machine and a method for the production of the micro-pump.

SUMMARY OF THE INVENTION

The object described above is accomplished by a micro-pump which is characterized by comprising a cylinder destined to serve as a stationary electrode, a piston formed inside the cylinder and intended to serve as a movable electrode, a conductive support serving to support the piston, a check valve and having a drive source integrally formed therein.

The object is further accomplished by a micro-pump which is characterized by comprising a piston for pressing a fluid, a movable electrode integrally formed with the piston, a cylinder for housing the piston, a conducting film for grounding the piston and the movable electrode, a cheek valve and a drive source integrally formed therein and allowing the opposite end faces of the piston press the fluid.

The object is also accomplished by a method for the production of a micro-pump which is characterized by comprising a step of forming a cylinder destined to serve as a stationary electrode in a substrate, a piston destined to serve as a movable electrode in the cylinder, and a conductive support for supporting the piston, a step of forming a check valve in another substrate, and a step of superposing the substrate forming the check valve on the substrate forming the cylinder as the stationary electrode, the piston serving as the movable electrode in the cylinder, and the conductive support for supporting the piston.

The object described above is further accomplished by a method for the production of a micro-pump recited in the preceding paragraph, which method is characterized by comprising a step of forming a piston for pressing a fluid in a substrate, a movable electrode integral with the piston, a cylinder for housing the piston, and a conductive film for grounding the piston and a movable electrode, a step of forming a cheek valve in another substrate, and a step of superposing the substrate forming the cheek valve on the substrate forming the piston, movable electrode, cylinder, and conductive film.

The substrates which are used in this invention are glass substrates and semiconductor substrates, preferably silicon substrates.

The micro-pump of this invention permits integral formation of a drive source therein as described above, thereby allowing simplification of peripheral mechanisms thereof, and it can be manufactured in a small overall size. The micro-pumps of this invention illustrated in FIG. 5 and FIG. 6 allow a reduction in the pulsation of the fluid being transferred. Since these micro-pumps allow adoption of the dispersed system in which the pumps are disposed for exclusive use one by one for such work units as micro-grippers, they minimize the whole length of the fluid transmission system, diminish the transmission loss, eliminate the complexity of piping, and realize the operation of micro-machines with pumps having a minimum capacity.

DESCRIPTION OF THE PREFERRED EMBODIMENTS

The micro-pump of this invention basically is a positive-displacement type pump which operates by the use of a linear actuator. This micro-pump aspirates and discharges a fluid in one fixed direction because a piston which produces a reciprocating motion effects the transmission of a fluid by changing the inner volume of a cylinder and a cheek valve restricts the direction of flow of the fluid.

Generally, pumps of this type comprise a cylindrical part and a piston interlocked with a power source and consequently able to reciprocate inside the cylinder and obtain a compression ratio as desired. The present invention contemplates diverting this piston to a movable electrode and the cylinder to a stationary electrode and, by application of an alternating current between the movable electrode and the stationary electrode, causing the piston as the movable electrode to be moved with electrostatic attraction.

Owing to the construction described above, the micro-pump of this invention has the drive source of the pump and the pump body integrated and, therefore, obviates the necessity of a drive source exclusively for the pump body and realizes the production of an extremely small pump. Further, the fact that the pump itself concurrently serves as a drive source and effects direct operation of the pump piston contributes to curbing the transmission loss of the driving force and enables the pump to operate with a small driving force.

Now, the construction and operating principle of the micro-pump of this invention will be described.

Figure 1:
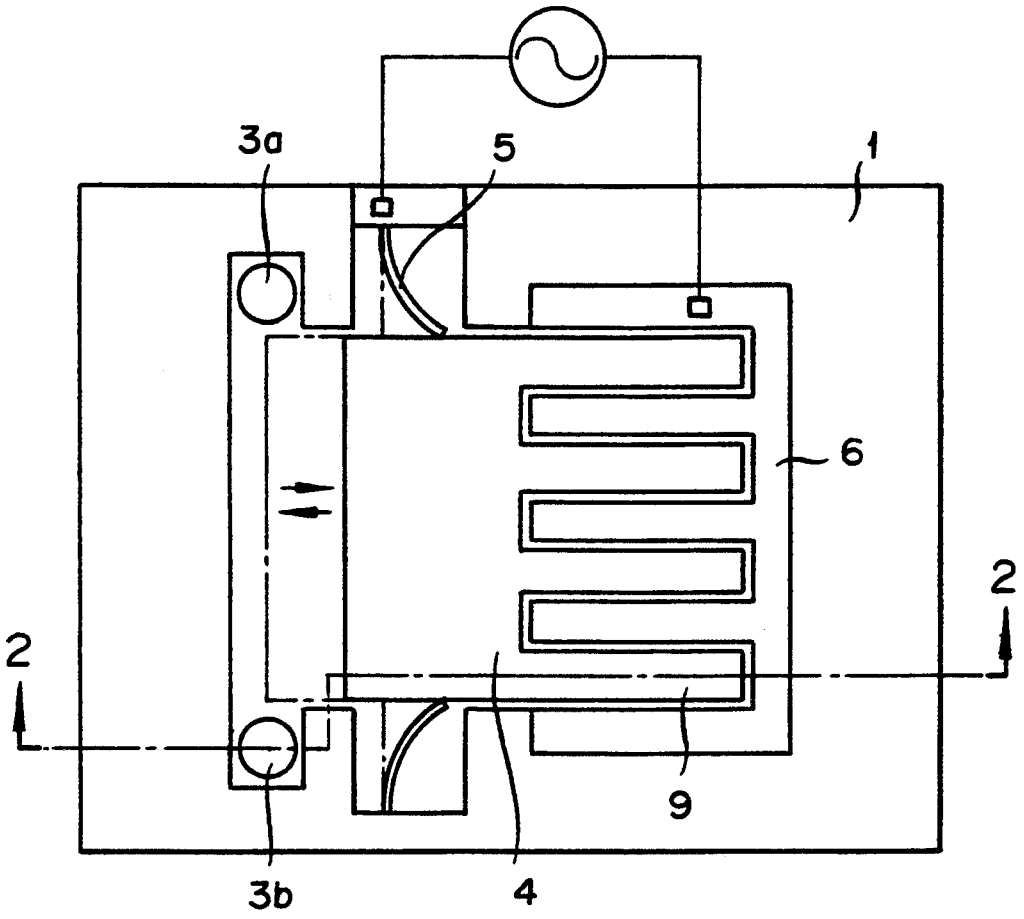
FIG. 1 is a plan view for aiding in the explanation of the principle of a micro-pump of this invention.
Figure 2:
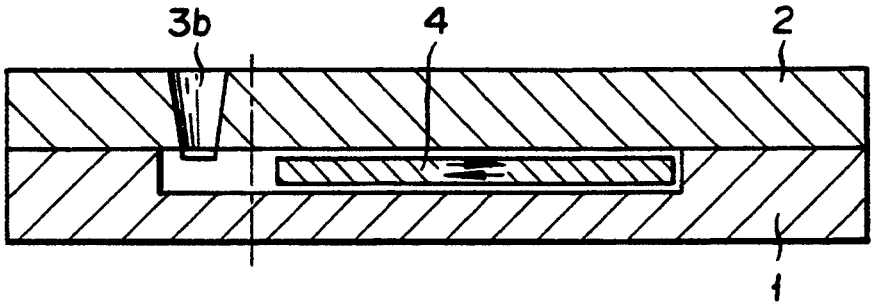
FIG. 2 is a cross section taken through FIG. 1 along the section line 2—2.

The micro-pump of this invention, as illustrated in FIG. 1 and FIG. 2, comprises semiconductor substrates 1 and 2, check valves **3*a* and 3*b* formed in the semiconductor substrate 2, a piston 47 a movable electrode 9, and a conductive support 5 for supporting the piston 4 and movable electrode 9 and, at the same time, supplying electric power thereto. It further comprises a diffusion layer region 6 which is formed in the semiconductor substrate 1** and destined to serve as a cylinder-fixing electrode.

Figure 3:
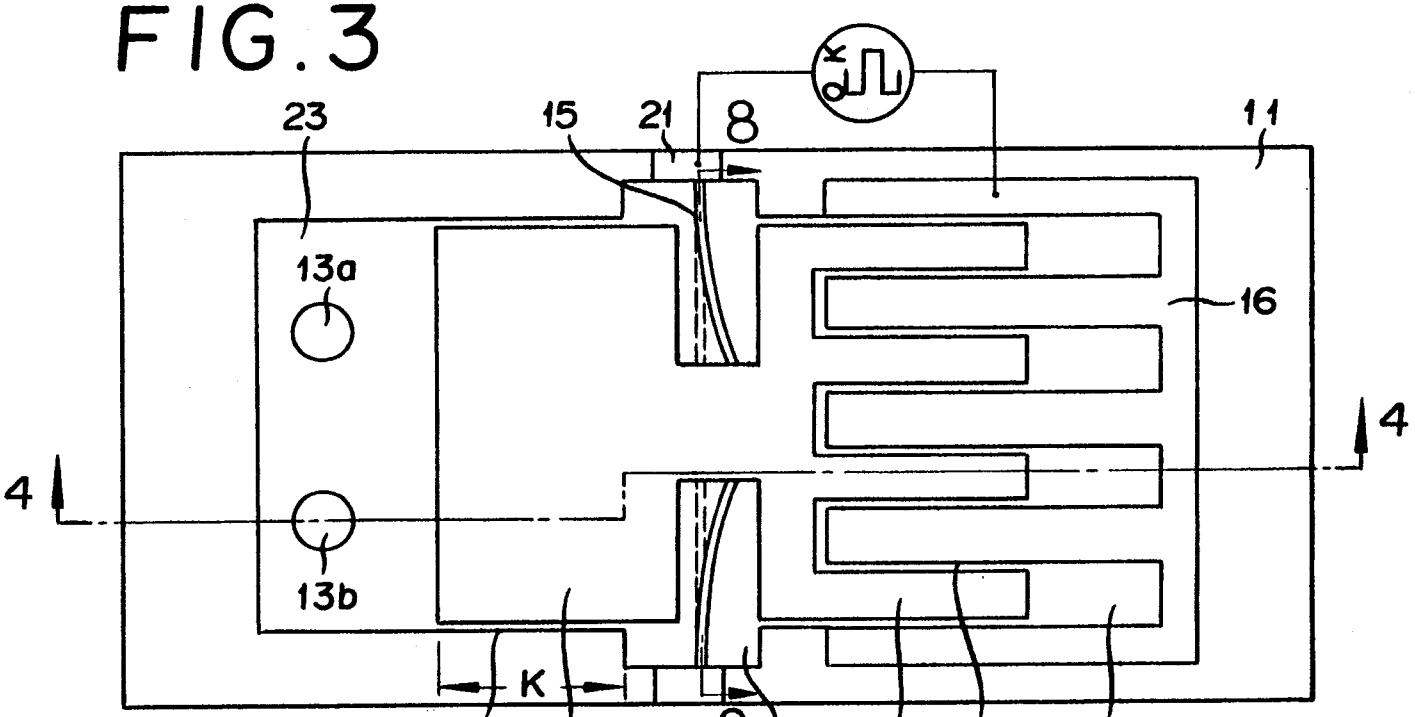
FIG. 3 is a plan view illustrating a micro-pump as another embodiment of this invention.
Figure 4:
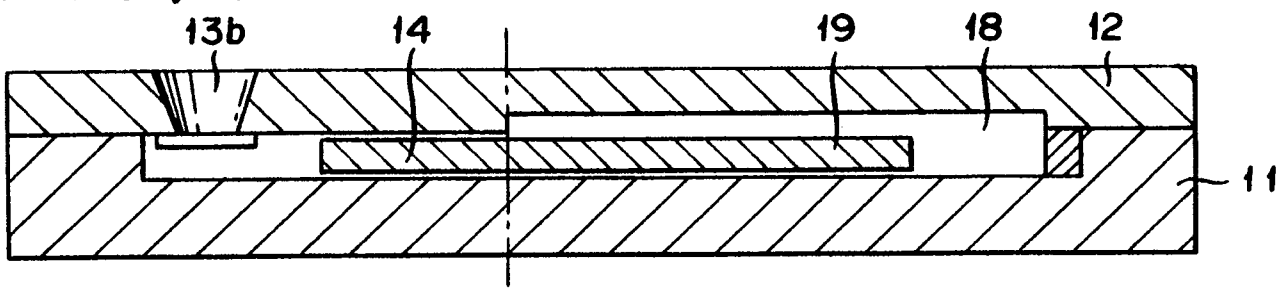
FIG. 4 is a cross section taken through FIG. 3 along the section line 4—4.

In the micro-pump illustrated as one embodiment in FIG. 3 and FIG. 4, a depression with a depth in the range of from 30 to 80 μm, about 50 μm for example, is formed in part of a silicon substrate 12, namely the part covering a movable electrode 19 formed integrally with a piston 14, and a stationary electrode 16 as illustrated in FIG. 4 so as to prevent the motion of the piston from giving rise to negative pressure or positive pressure in empty spaces 17 and 18.

The number of teeth of the comb of the movable electrode 19 is set at 11 (only four teeth are drawn in FIG. 3 for the sake of the simplicity of the drawing). The interval 20 between the movable electrode 19 and the stationary electrode 16 is in the range of from 0.2 to 2 μm, about 1 μm for example. The micro-pump is driven by applying a square-wave voltage having a peak of 100 V between a diffusion terminal 21 externally connected to a conductive support 15 and the stationary electrode 16, The conductive support 15, as illustrated in FIG. 3, is formed to measure 720 to 900 μm, about 850 μm for example, in length, 30 to 80 μm, about 50 μm for example, in height, and 7 to 20 μm, about 10 μm for example, in thickness so as to generate a resilient force large enough to counterbalance the electrostatic attraction when it is deflected in a size in the range of 1 to 10 μm, about 5 μm for example, by the motion of the piston 14. In this embodiment, the part interconnecting the piston 14 and the movable electrode 19 is given a decreased width so as to allow an ample length to the conductive support 15.

Further, in the micro-pump of this embodiment, the length K of the sealed part is larger than the stroke of the piston so as to amply decrease the conductance between the piston 14 and the cylinder 22 as compared with the normal direction conductance of cheek valves **13*a* and 13*b*. Owing to this difference in conductance, when the motion of the piston changes the inner volume of a fluid chamber 23, the cheek valves 13*a* and 13*b*** are able to discharge and aspirate the fluid.

The micro-pump of this embodiment measures $1\times2\times2$ mm$^3$. This micro-pump in a complete form discharges the fluid at a pressure of 4 gf/cm$^2$ at a flow volume of 0.1 μl/min.

Figures 5, 6:
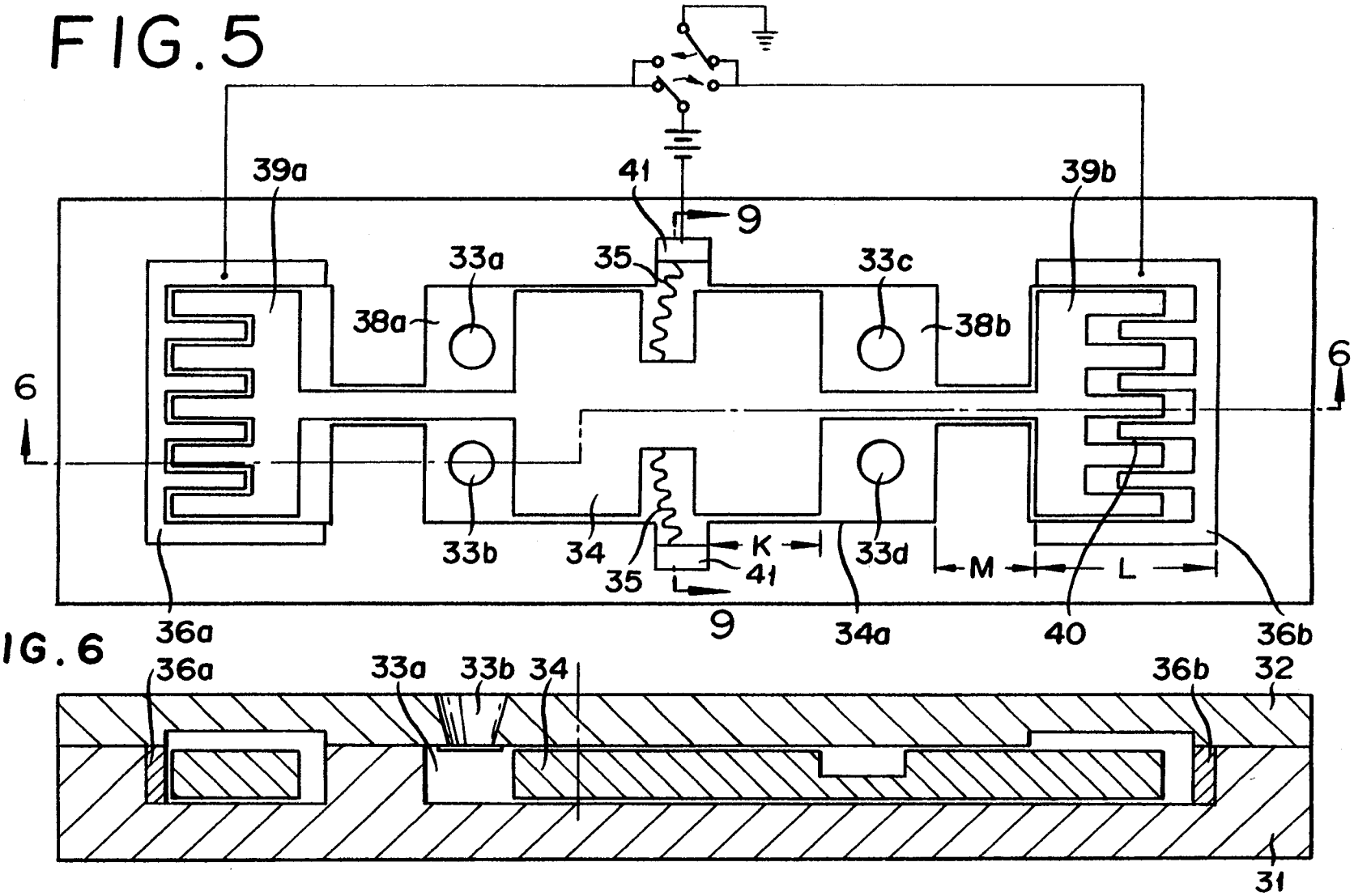
FIG. 5 is a plan view illustrating a micro-pump as yet another embodiment of this invention.
FIG. 6 is a cross section taken through FIG. 5 along the section line 6—6.

FIG. 5 and FIG. 6 illustrate a micro-pump as another embodiment of this invention. It comprises semiconductor substrates 31 and 32, cheek valves 33*a*, 33*b*, 33*c*, and 33*d* formed in the semiconductor substrate 32, a piston 34, and a conductive film 35 for applying a voltage to the piston 34. It further comprises comb-shaped diffusion layer regions 36*a* and 36*b* which are destined to serve as stationary electrodes, Movable electrodes 39*a* and 39*b* are formed integrally with the piston 34, These movable electrodes 39*a* and 39*b* are each formed in the shape of a comb so as to fit the stationary electrodes.

The micro-pump illustrated in FIG. 5 and FIG. 6 is constructed so that the flow of the fluid is produced both during the forward motion and backward motion of the piston 34. Here, the conductive film 35, the piston 34, and the movable electrodes 39*a* and 39*b* constantly have a grounded potential. While the voltage is applied between the movable electrode 39*b* and the diffusion layer region 36*b*, the diffusion layer region 36*a* is set at the grounded potential and the piston 34 formed integrally with the movable electrode 39*b* is attracted toward the diffusion layer region 36*b* side by the electrostatic attraction generated between the movable electrode 39*b* and the diffusion layer region 36*b*. At this time, the fluid is introduced into an operating chamber 38*a* by the aspirating side check valve 33*b* and it is discharged from a fluid chamber 38*b* through the discharging side check valve 33*c*. During the next period, the voltage is applied between the diffusion layer region 36*a* and the movable electrode 39*a* and the diffusion layer region 36*b* is grounded. At this time, the movable electrode 39*a* is attracted toward the diffusion layer region 36*a*. As a result, the fluid inside the operating chamber 38*a* is discharged through the discharging side cheek valve 33*a* and it is introduced into the operating chamber 38*b* through the aspiring side cheek valve 33*d*. By repeating the operation described above, the micro-pump fulfills its role as a pump. The pump of this construction, unlike the Dump illustrated in FIG. 1 and FIG. 2, does not rely on the resilient force of the conductive support to drive the piston. Thus, the conductive film is manufactured with a softness high enough to avoid interfering with the motion of the piston.

Owing to the construction described above, the action of producing the flow of the fluid continues both during the forward motion and backward motion of the piston. Thus, the micro-pump of this embodiment has the effect of decreasing pulsations of the fluid as compared with the micro-pump illustrated in FIG. 1 and FIG. 2.

In the micro-pump illustrated in FIG. 5 and FIG. 6, the movable electrodes 39*a* and 39*b* and the diffusion layer regions 36*a* and 36*b* are coupled after the fashion of clasped hands to ensure efficient generation of the electrostatic attraction. The length L of the clasped hands is desired to be greater than the stroke of the piston.

Let n stand for the number of teeth of the comb of the movable electrodes, 9, 19, and 39, and the electrostatic capacity C between the movable electrode and the diffusion layer regions 6, 16, and 36 serving as the stationary electrodes will be expressed by the following formula.

$$C=(n-1)\epsilon S/d=(n-1)(\epsilon/d).h.(l+2x) \quad (1)$$

wherein h is the thickness (height) of the movable electrode, l is the initial value of the overlap of the coupled comb-shaped electrodes, x is the amount of motion of the piston, and $\epsilon$ is the dielectric constant of air ($8.854\times10^{-12}$ F/m).

The electrostatic energy U to be accumulated when the voltage V is applied between the two electrodes is expressed by the following formula 2.

$$U=(\tfrac{1}{2})CV^2 \quad (2)$$

Thus, the magnitude F of the electrostatic attraction is expressed by the following formula 3.

$$F=du/dx=\tfrac{1}{2}.V^2.dc/dx=(n-1)(\epsilon/d).h.V^2 \quad (3)$$

The electrostatic attraction which is required, therefore, can be obtained by suitably setting the number n of teeth of the comb, the thickness h of the movable electrode, and the magnitude of the applied voltage.

When the movable electrodes 9 and 19 are moved by a displacement v, the conductive supports 5 and 15 are deflected by the same displacement v. Since two conductive supports are simultaneously in use herein, the resilience W of the conductive supports is only required to be set so as to satisfy the following formula 4.

$$W=F/2 \quad (4)$$

Incidentally, the resilience W is expressed by the following formula 5 in which v is the amount of displacement.

$$W=(3EI/L^3)v \quad (5)$$

wherein L is the length of the support, E is the Young' modulus of the supporting material, and I is the secondary moment of cross section of the support as expressed by the formula, $I=(1/12)k.t^3$, k is the height of the support, and t is the thickness of the support.

The resilient force which is expressed by the formula shown above can be obtained as required by suitably selecting the material, length, and cross-sectional area of the conductive support.

The overall size of the micro-pump of this invention is approximately such that the cross-sectional area is in the range of from 1 to 5 $mm^2$, the width in the range of from 1 to 4 mm, the length (In the direction of motion of the piston) in the range of from 2 to 4 mm, and the height (thickness) in the range of from 0.5 to 1 mm. In this micro-pump, the flow volume of the fluid is approximately in the range of from 0.1 to 1 $\mu$l/minute. The stroke of the pistons 4, 14, and 34 is desired to be approximately in the range of from 1 to 10 $\mu$m, preferably from 1 to 5 $\mu$m. If this stroke is excessively long, the conductive supports 5 and 15 or the conductive film 35 sustains breakage, depending on the material used for the supports 5 and 15 or the film 35.

For the operation of the micro-pump of this invention, an AC voltage is applied between the diffusion layer regions 6 and 16 which are cylinder stationary electrodes of the substrates 1 and 11 and the movable electrodes 9 and 19 and, as a result, the movable electrodes 9 and 19 are drawn by the electrostatic attraction toward the diffusion layers 6 and 16 and the aspirating side cheek valves 3*b* and 13*b* are actuated to allow the introduction of the fluid into the operating chamber. When the application of the AC voltage ceases, the conductive supports 5 and 15 which have been deformed (elongated) in consequence of the motion of the pistons 4 and 14 are urged to resume the original shape and the urging force so generated moves the pistons 4 and 14 and consequently causes the discharging side check valves 3*a* and 13*a* to discharge the fluid from inside the operating chamber. The micro-pump is able to fulfill its function as a pump by repeating the operation described above.

In the operation of the micro-pump of this invention shown in FIG. 5 and 6, a DC voltage is adopted between the diffusion layer region 36*a* which are cylinder stationary electrodes of the substrate 31 and the movable electrode 39*a* and, as a result, the movable electrode 39*a* is drawn by the electrostatic attraction towards the diffusion layer region 36*a* and the aspirating side cheek valve 33*d* is actuated to allow introduction of the fluid into the operating chamber 38*b* and also causing the fluid in the operating chamber 38*a* to discharge from the discharging side check valve 33*a*.

Then the diffusion layer region 36*a* is set as the ground voltage, and a DC voltage is applied between the diffusion layer region 36*b* and the movable electrode 39*b*. As a result, the movable electrode 39*b* is drawn by the electrostatic attraction towards the diffusion layer region 36*b* and the aspirating side check valve 33*b* is actuated to allow the introduction of the fluid into the operating chamber 38*a* and also causing the fluid in the operating chamber 38*b* to discharge from the discharging side check valve 33*c*.

The micro-pump of this invention can be manufactured by partial application of the micro-machining technique which has been employed in the conventional process for the production of semiconductor elements.

Figure 7A:
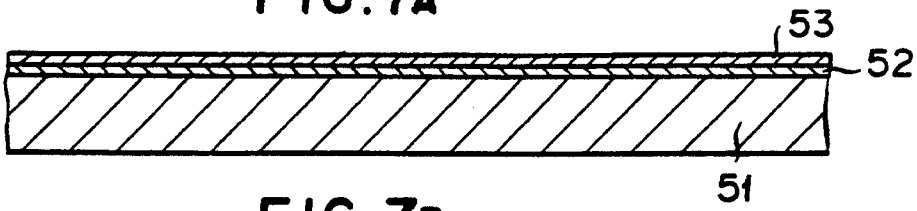
FIGS. 7A to 7H are process diagrams for aiding in the explanation of a method for the production of a piston part and a conductive support part of the micro-pump of this invention.
Figure 7B:
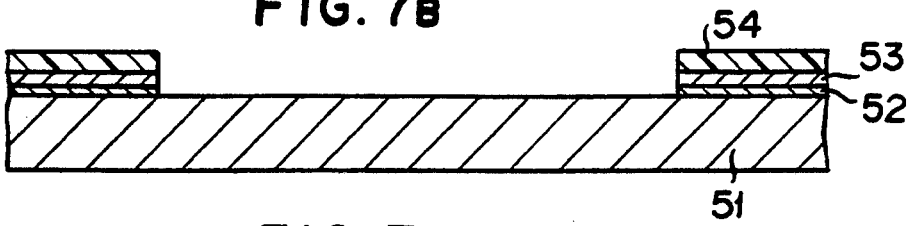

In the manufacture of the micro-pump illustrated in FIG. 3 and FIG. 4, for example, the piston part is formed as a first step. FIGS. 7A–H are cross sections in manufacturing steps and which being taken along a same line corresponding with the line 8—8 of FIG. 3. A masking material is formed on a substrate 51 throughout the entire surface thereof as illustrated in FIG. 7A. This masking material is used in the subsequent step for the information of a piston movable region in the substrate 51. It may be a silicon oxide film, a silicon nitride film, or a laminate of a silicon oxide film 52 and a silicon nitride film 53. A patterning is performed on the masking material through the medium of a photoresist 54 to etch the masking material as illustrated in FIG. 7B. Then, the substrate 51 is etched as illustrated in FIG. 7B by reactive ion etching (RIE) or wet etching, preferably RIE in due consideration of dimensional accuracy. The depth of this etching is approximately in the range of from 5 to 100 μm, preferably from 30 to 80 μm.

Figure 7C:
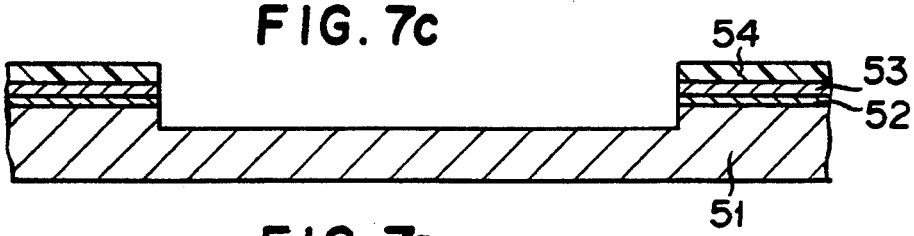
Figure 7D:
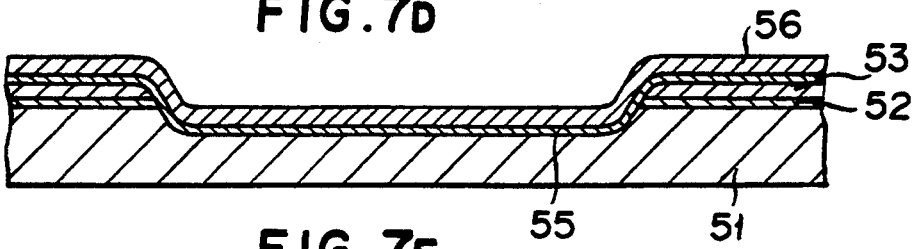

Now, a silicon oxide layer 55 is superposed in a thickness approximately in the range of from 0.1 to 1 μm by the CVD method, for example, as illustrated in FIG. 7D. Subsequently, on this silicon oxide film, a polysilicon film 56 is superposed in a thickness approximately in the range of from 5 to 100 μm by the CVD method, for example. The thickness of this polysilicon layer is fixed in accordance with the depth of etching of the substrate 51. The silicon oxide film 55 is intended to allow formation thereon of the polysilicon layer destined to form a piston. Thus, the silicon oxide film 55 intervening between the substrate and the polysilicon layer will subsequently be required to be removed. If the thickness of this silicon oxide film 55 is unduly small, the disadvantage arises that it wall not be thoroughly removed. The thickness of the polysilicon layer is desired to be slightly smaller, specifically by 1 to 3 μm less than the depth of depression formed in the substrate.

Figure 7E:
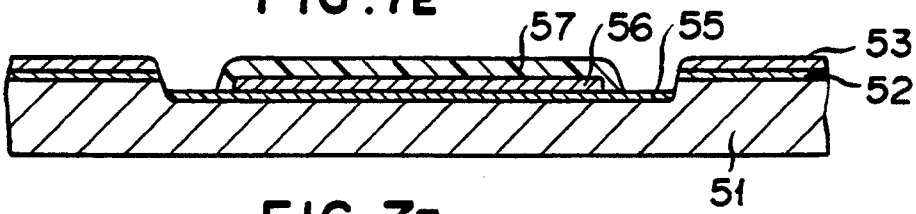

In the subsequent step of photolithography, application of resist and patterning are carried out to form a piston by etching the polysilicon layer desirably by the RIE technique as illustrated in FIG. 7E. Then, a resist 57 is applied so as to cover the piston and pattern the deposited resist 57 by means of photolithography. At this time, the resist 57 is patterned so that the oxide film lying in the lateral surface of the depression formed for the piston moving part in the substrate will be exposed. The silicon oxide film in the lateral surface of the depression of the substrate 51 is removed by isotropic etching such as the CDE technique to expose the silicon layer in the lateral surface of the depression. The purpose of this exposure of the silicon layer comprises allowing fixation to the substrate of the end of a conductive support serving to support the piston to be formed subsequently and permitting the conductive support to be moved sufficiently.

Figure 7F:
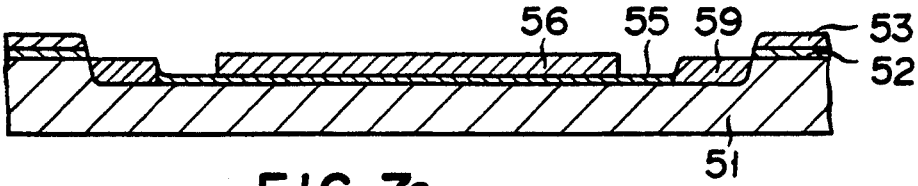

Then, the masking materials 52 and 53 on the silicon substrate are selectively removed and arsenic, phosphorus, or boron are thermally diffused on the substrate and the piston, depending on the quality of the silicon substrate, to form a movable electrode and a diffusion layer 59 in the part destined to serve as an electrode as illustrated in FIG. 7F.

Figure 7G:
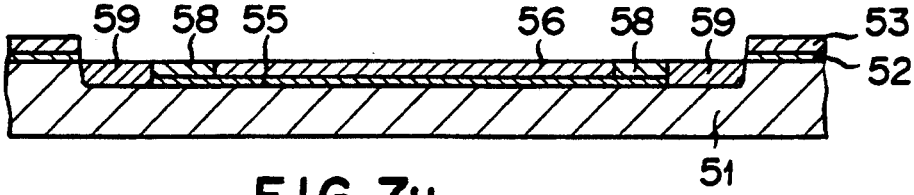

Subsequently, a conductive support 58 is formed as illustrated in FIG. 7G. This formation is effected by forming a film of such metal as nickel or copper in a thickness in the range of from 0.1 to 1 μm by the vacuum deposition technique or spattering technique and then patterning the produced metal film. After the used resist is removed and then a fresh resist is applied in a thickness thicker than that of the piston, the applied layer of resist is patterned so as to expose the formerly formed pattern of conductive support. Thereafter, the conductive support is formed by plating the previously formed pattern of conductive support with such a metal as nickel or copper with the freshly formed pattern of the resist as the molding form.

Figure 7H:
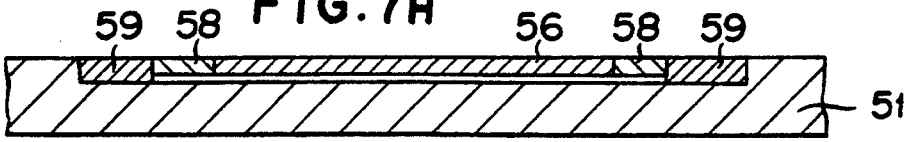

Then, the entire substrate inclusive of the superposed layers immersed in an aqueous hydrogen fluoride solution, preferably in hydrofluoric acid of a high concentration, so as to remove the masking materials 52 and 53, smooth the surface, and remove the silicon oxide film 25 from between the piston and the substrate as illustrated in FIG. 7H. As a result, the piston is rendered movable and the formation of the piston is completed.

In the micro-pump illustrated in FIG. 5 and FIG. 6, the piston part and the comb-shaped electrodes are simultaneously formed. FIGS. 8A to 8G represent cross sections in manufacturing steps and which being taken along a same line corresponding to the line 6—6 of FIG. 5 and FIGS. 9A to 9C cross sections in manufacturing steps and which being taken alone a same line corresponding to the line 9—9 of FIG. 5.

Figure 8A:
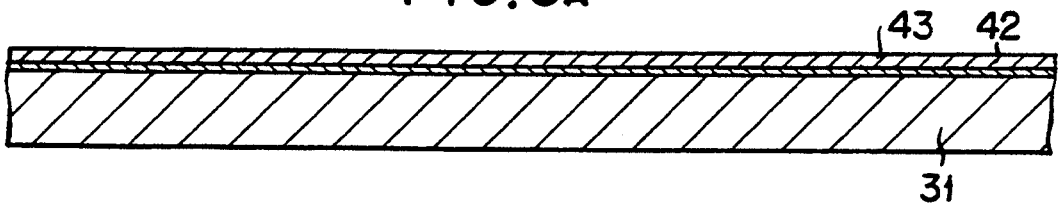
FIGS. 8A to 8G are process diagrams for aiding in the explanation of another method for the production of the piston part of the micro-pump of this invention.
Figure 8B:
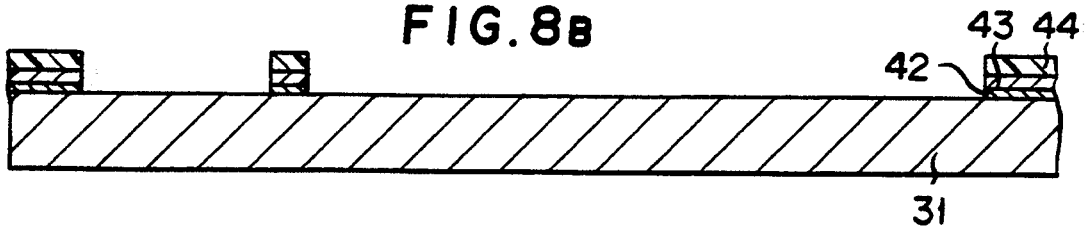

A masking material is formed on the silicon substrate 31 throughout the entire surface thereof as illustrated in FIG. 8A. This masking material is used in the subsequent step for the purpose of forming in the substrate 31 a region which allows the piston and the comb-shaped electrodes to be moved. It is a silicon oxide film, a silicon nitride film, or a laminate of a silicon oxide film 42 and a silicon nitride film 43. This masking material is patterned through the medium of a photoresist 44 to etch the masking material as illustrated in FIG. 8B.

Figure 8C:
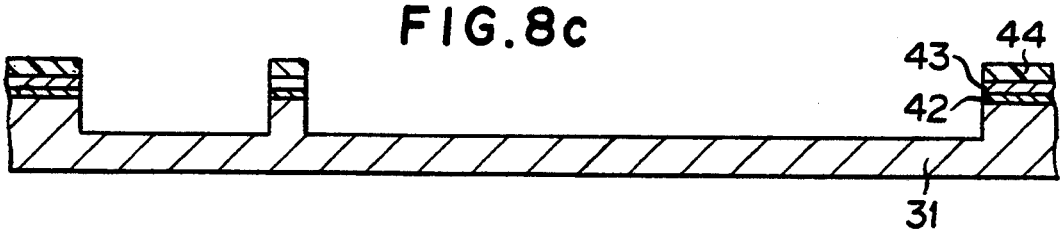

Then, the substrate 31 is etched by reactive ion etching (RIE) or wet etching, preferably by RIE on account of dimensional accuracy, as illustrated in FIG. 8C. The depth of this etching is approximately in the range of from 5 to 100 μm, preferably from 30 to 80 μm.

Figure 8D:
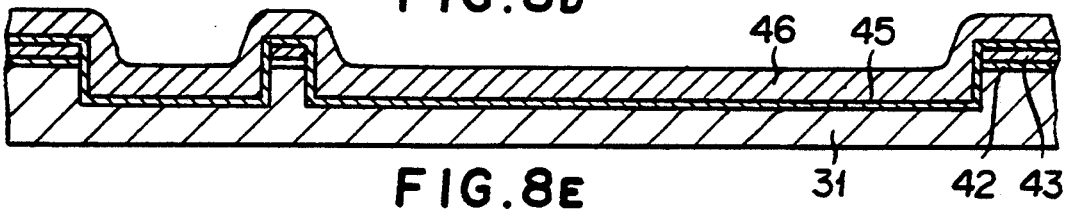

Subsequently, a silicon oxide film 45 is formed in a thickness approximately in the range of from 0.1 to 1 μm by the CVD method, for example, and a polysilicon layer 46 is superposed on the silicon oxide film in a thickness approximately in the range of from 5 to 100 μm by the CVD method, for example, as illustrated in FIG. 8D. Here, during the formation of the polysilicon layer, an impurity substance is incorporated therein for the purpose of imparting electroconductivity to the polysilicon layer. The thickness of the polysilicon layer is fixed in accordance with the depth of etching of the substrate 31. The silicon oxide film 45 is intended to allow formation thereon of the polysilicon layer for forming a piston and movable electrodes. The silicon oxide film 45 intervening between the substrate and the polysilicon layer will be subsequently required to be removed. If the thickness of the silicon oxide film 45 is unduly small, a disadvantage arises in that it cannot be thoroughly removed.

The thickness of the polysilicon layer is desired to be slightly smaller, specifically by 1 to 3 μm less than the depth of the depression formed in the substrate.

Figure 8E:
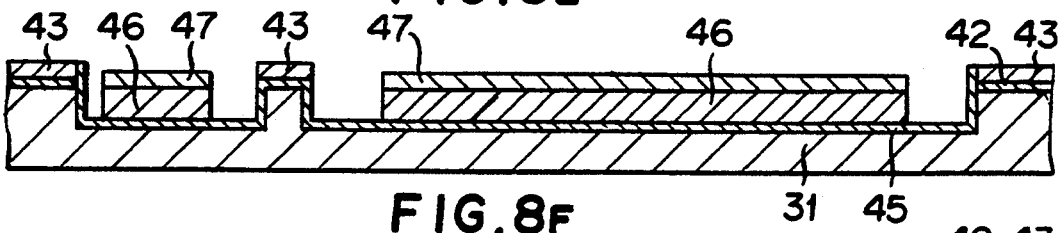

Then, in the step of photolithography, a resist 47 is applied and patterned and the polysilicon layer is etched preferably by the RIE method to give rise to a piston and movable electrodes as illustrated in FIG. 8E.

Figure 8F:
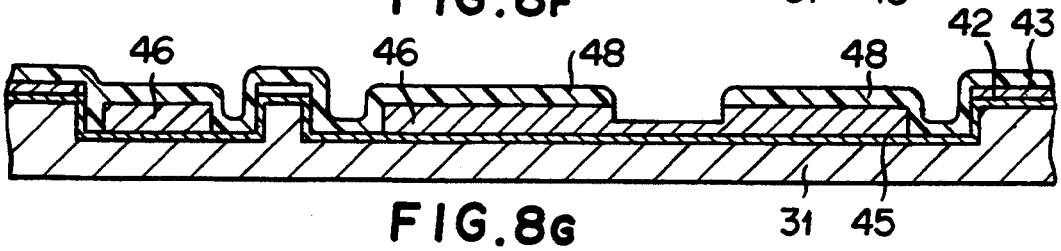

Further, a resist 48 is applied and patterned in such a manner as to allow only the part interconnecting the piston and the movable electrodes to be left exposed and the polysilicon layer is etched to a depth in the range of from 15 to 40 μm desirably by the RIE method as illustrated in FIG. 8F.

Figure 8G:
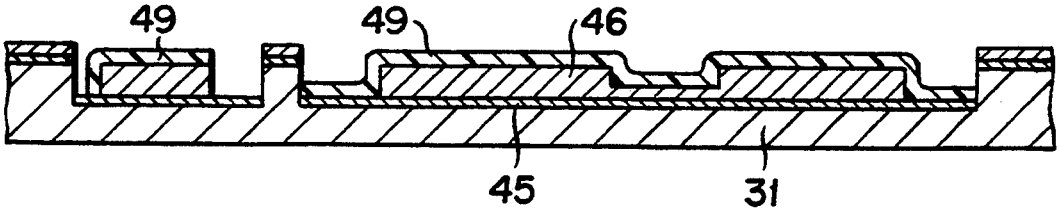

Then, a resist 49 is applied and patterned so as to expose the oxide film lying in the lateral surface of the depression formed in the substrate for the sake of the movable part of the piston and the silicon oxide film in the lateral surface is removed by isotropic etching such as the CDE method to expose the silicon in the lateral surface, as shown in FIG. 8G. The purpose of this exposure of the silicon surface is to allow fixation on the substrate of the end of the conductive film intended to connect the piston to be subsequently formed and enable the conductive film to be sufficiently moved.

Figure 9A:
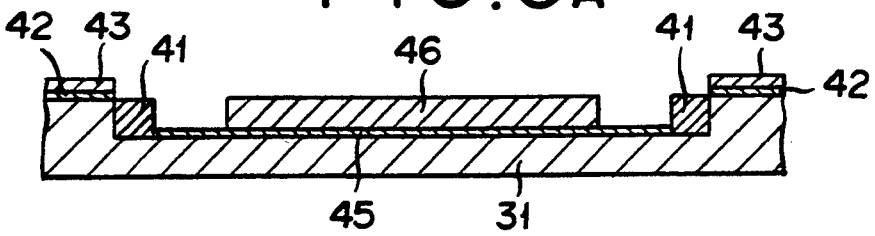
FIGS. 9A to 9C are process diagrams for aiding in the explanation of the formation of a conductive film of the micro-pump of this invention.

Then, the masking materials 42 and 43 on the silicon substrate are selectively removed and arsenic, phosphorus, or boron are thermally diffused on the substrate and the piston, depending on the quality (n type or p type) of the silicon substrate 31, to form a diffusion layer 41 in the part destined to serve as an electrode as illustrated in FIG. 9A.

Figure 9B:
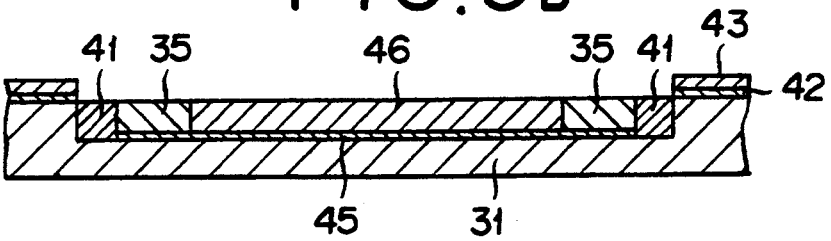

Subsequently, a conductive film 35 is formed as illustrated in FIG. 9B. This formation is effected by forming a film of such metal as nickel or copper in a thickness in the range of from 0.1 to 1 μm by the vacuum deposition technique or spattering technique and then patterning the produced metal film. After the used resist is removed and then a fresh resist is applied in a thickness thicker than that of the piston, the applied layer of resist is patterned so as to expose the formerly formed pattern of conductive support. Thereafter, the conductive film 35 is formed by plating the previously formed pattern of conductive support with such a metal as nickel or copper with the freshly formed pattern of the resist as the molding form.

Figure 9C:
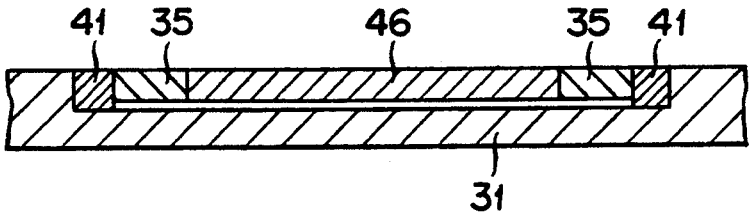

Then, the entire substrate inclusive of the superposed layers is immersed in an aqueous hydrogen fluoride solution, preferably in hydrofluoric acid of a high concentration, so as to remove the masking materials 42 and 43, smooth the surface, and remove the silicon oxide film 45 and the silicon oxide film from between the piston, the movable electrode 46, and the substrate 31 as illustrated In FIG. 9C. As a result, the piston and the movable electrodes are rendered movable and the formation of the piston and the movable electrodes is completed.

Then, check valves are manufactured with another substrate.

Figure 10A:
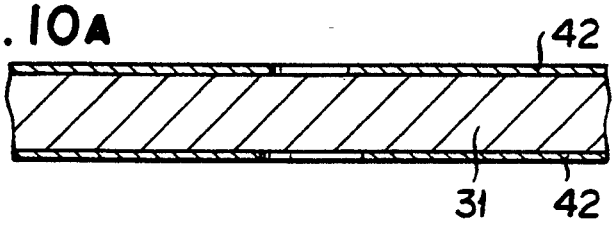
FIGS. 10A to 10F are process diagram for aiding in the explanation of a method for the production of a valve part of the micro-pump of this invention.

Silicon oxide films 42 are formed one each on the opposite mirror polished surfaces of a substrate 41 having a thickness approximately in the range of from 100 to 400 μm, preferably from 100 to 200 μm and the portions of the silicon oxide film for fixing on the substrate the parts and valve arms to be formed at the subsequent step are removed by photolithographic patterning as illustrated in FIG. 10A. In this case, when the substrate has a small thickness, it fits more the formation of through holes which will be described below than when it has a large thickness. This substrate, however, is required to have a thickness large enough to preclude possible breakage in the process of perforation.

Figure 10B:
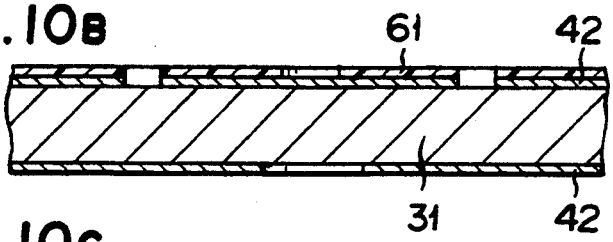

Now, PSG films 61 are formed as illustrated in FIG. 10B. These PSG films 61 are intended to give rise to lower steps of the valves and have a thickness approximately in the range of from 0.1 to 1 μm. The portions of the PSG films 61 destined to allow fixation of the arms of the valves on the substrate are removed by photolithographic patterning.

Then, polysilicon films 62 are formed in a thickness approximately in the range of from 4 to 18 μm as by the CVD method, patterned by photolithography, and etched by RIE or CDE to form the valves proper and the parts used for fixing the valves.

Figure 10C:
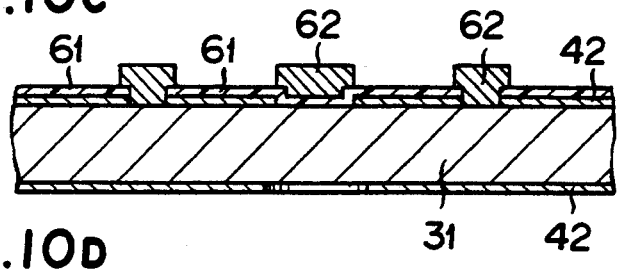
Figure 10D:
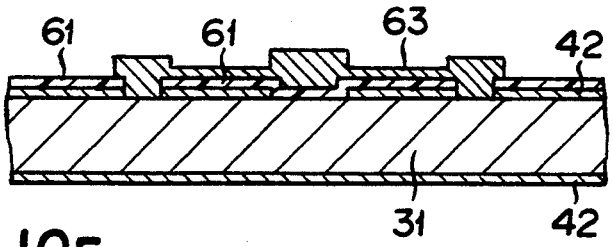

Polysilicon films 63 are formed in a thickness approximately in the range of from 2 to 4 μm as by the CVD method, patterned by photolithography, and etched by RIE or CDE to form the parts destined to form the arms of valves as illustrated in FIG. 10D.

Figure 10E:
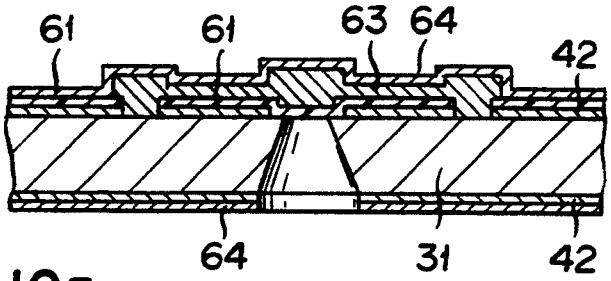
Figure 10F:
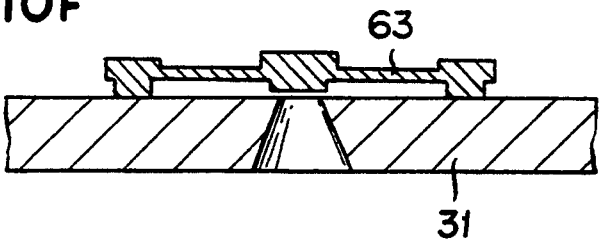
Figure 11:
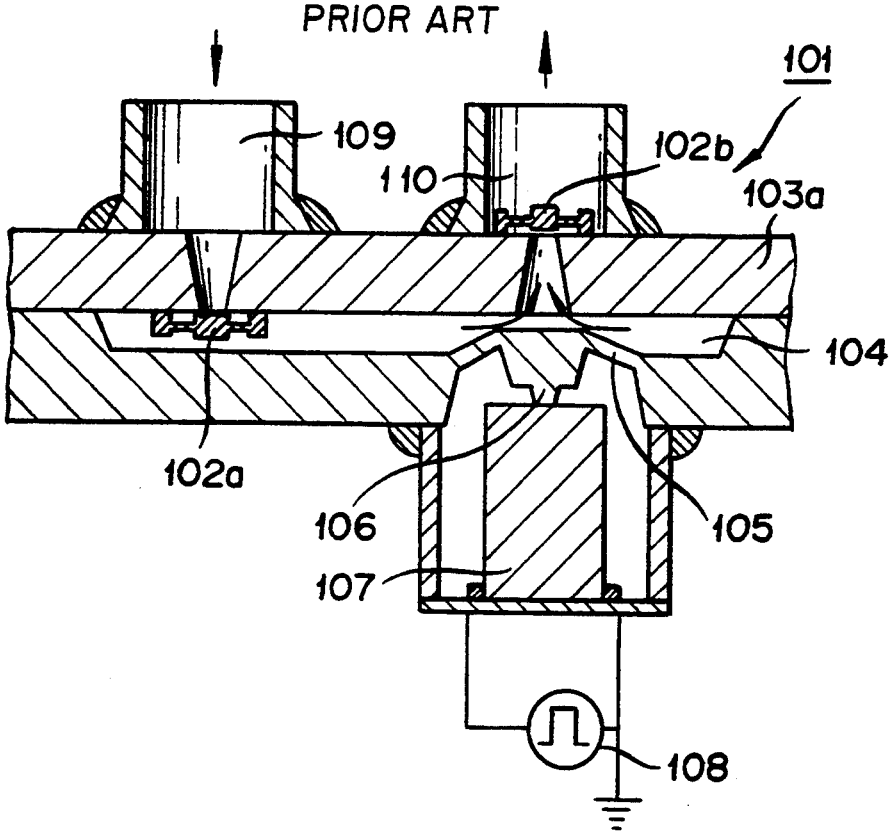
FIG. 11 PRIOR ART
FIG. 11 is a cross section of a conventional micro-pump.

Subsequently, silicon oxide films and silicon nitride films are formed on the obverse surface (the surface on the valve parts have been formed as described above) and on the reverse surface to give rise to masking materials 64 for the formation of flow paths as illustrated in FIG. 10E. The portions of the silicon oxide film 42 and the silicon nitride film 64 which are destined to form the flow path on the reverse surface are removed and etched anisotropically to open a through hole. Though this anisotropic etching may be effected in the form of dry etching such as RIE, it is preferably performed in the form of wet etching by the use of an aqueous solution containing potassium hydroxide at a concentration of about 35% by weight. When the aqueous potassium hydroxide solution is used and the substrate happens to be made of a (100) single crystal silicon, the flow path is formed in the shape of a funnel having a suitably inclined wall as illustrated in the diagram.

Finally, the entire substrate inclusive of superposed films is immersed in hydrofluoric acid of high concentration to effect complete removal of the silicon oxide film 42, PSG films 61, silicon oxide films, and silicon nitride films 64 and complete the process for the formation of the check valves. The micro-pump illustrated in FIG. 5 and FIG. 6 have the same valves formed two each on the opposite surfaces of the substrate.

The micro-pumps are completed, as illustrated in FIGS. 1 to 6, by joining face to face the two substrates having pistons and valves formed thereon as described above. This bonding the two substrates can be accomplished, for example, by applying a layer of low-melting glass by spattering to the lower surfaces of the substrates 1, 11, and 31, superposing the substrates 1, 11, and 31 on the substrates 2, 12, and 32 as accurately registered, heating the superposed substrates and simultaneously applying thereto a DC voltage of about 100 V thereby inducing anodic bonding.

The substrates 1, 11, 31, 2, 12, and 32 are only required to be made of a material which can be machined by the micro-machining technique to be used for the production of semiconductor elements. Silicon substrates and gallium-arsenic substrates, for example, answer the description. In terms of machinability, economy, etc., however, the silicon substrates which are used generally in semiconductor elements of ordinary grade prove to be particularly desirable.

Now, this invention will be described more particularly below with reference to working examples, which are illustrative and not limitative of this invention.

Formation of piston park:

First, a silicon oxide film 52 is formed in a thickness of 0.1 μm by the thermal oxidation method on an n-type silicon substrate 51 throughout the entire surface thereof and a silicon nitride film 53 is superposed thereon in a thickness of 0.25 μm by the use of a LPCVD in FIG. 7A. A photoresist 54 is applied to the silicon nitride film 53. The silicon oxide film 52 and the silicon nitride film 53 are patterned by etching as illustrated in FIG. 7B through the medium of the photoresist 54.

Then, the silicon substrate 51 is etched by RIE as illustrated in FIG. 7C. The depth of this etching is about 55 μm.

A silicon oxide film 55 is formed in a thickness of about 0.8 μm by the normal-pressure CVD and a polysilicon layer 56 is superposed in a thickness of about 55 μm on the silicon oxide film 55 by the normal-pressure CVD as illustrated in FIG. 7D.

In the subsequent step of photolithography, a resist is applied and patterned and the polysilicon layer is etched by RIE through the medium of the patterned resist to form a piston as illustrated in FIG. 7E. Then, a resist 57 is applied to cover the piston and patterned by photolithography and the silicon oxide film in the lateral surface of the depression is removed by CDE to expose silicon.

Then, the masking materials 52 and 53 on the silicon substrate are selectively removed and boron is thermally diffused on the substrate and on the piston to form (to form) the comb-shaped movable/stationary electrodes and a diffusion layer 59 of the part destined to form the electrodes which are connected to the conductive supports as illustrated in FIG. 7F.

A conductive support 58 is then formed as illustrated in FIG. 7G. This formation is attained by first forming a film of a thickness in the range of from 0.1 to 1 μm by the spattering method and then patterning the formed film by photolithography. The used resist is removed and then a new resist is applied in a thickness of 60 μm and the applied layer of the resist is patterned so as to expose the formerly formed conductive support pattern. Thereafter, the formerly formed conductive support pattern is plated with copper in a thickness of 55 μm through the medium of the previously formed resist pattern as a molding form, to give birth to the conductive support.

Then, the entire substrate inclusive of the superposed films is immersed in an aqueous hydrogen fluoride solution, preferably in hydrofluoric acid of a high concentration to remove the masking materials 52 and 53, smooth the surface, and remove the silicon oxide film 55 from between the piston and the substrate Is illustrated in FIG. 7H. As a result, the piston is rendered movable and the formation of the piston is completed.

In another working example of this invention, a silicon oxide film 42 is formed in a thickness of 0.1 μm on a p-type silicon substrate 31 throughout the entire surface thereof by the thermal oxidation method and a silicon nitride film 43 is superposed thereon in a thickness of 0.25 μm by the LPCVD method as illustrated in FIG. 8A. A photoresist 44 is applied to the silicon nitride film 43 and patterned and, through the medium of the patterned photoresist 44, the silicon oxide film 42 and the silicon nitride film 43 are etched as illustrated in FIG. 8B.

Then, the silicon substrate 31 is etched by the RIE as illustrated in FIG. 8C. The depth of this etching is about 55 μm.

Subsequently, a silicon oxide film 45 is formed in a thickness of about 0.8 μm by the normal-pressure CVD and, on this silicon oxide film 45, a polysilicon layer 46 which has introduced phosphorus and acquired electroconductivity is superposed on a thickness of about 55 μm by the normal-pressure CVD method as illustrated in FIG. 8D.

In the subsequent step of photolithography, a resist 47 is applied and patterned and the polysilicon layer is etched through the medium of the patterned resist 47 to give rise to a piston and a movable electrode as illustrated in FIG. 8E.

Further, a resist 48 is applied in such a manner as to expose only the part interconnecting the piston and the movable electrode, the applied resist 48 is patterned, and the polysilicon layer is etched to a depth of 30 μm by the RIE through the medium of the patterned resist 48 as illustrated in FIG. 8F.

Then, a resist 49 is applied so as to cover the piston and the movable electrode and pattered by means of photolithography and the silicon oxide film in the lateral surface of the depression is removed by the CDE to expose the silicon as illustrated in FIG. 8G.

In the following description of working examples, FIGS. 9A to 9C represent cross sections taken through FIG. 5 along the line 9—9.

Now, the masking materials 42 and 43 on the silicon substrate are selectively removed and phosphorus is thermally diffused on the substrate to form diffusion layers 41 of the part destined to form electrodes as illustrated in FIG. 9A. In the same manner, phosphorus is also thermally diffused on the part destined to be the comb-shaped electrodes.

Then, a conductive film 35 is formed as illustrated in FIG. 9B. This formation is effected by first forming a copper film in a thickness of 0.1 μm by the spattering method and then patterning the copper film by means of photolithography. This conductive film is formed in an undulating pattern as illustrated in FIG. 5 so as to reduce the resilient force thereof. The used resist is removed, then a new resist is applied in a thickness of 60 μm, and the applied resist is patterned so as to expose the formerly formed pattern of conductive film. Thereafter, the conductive film is formed by plating the formerly formed pattern of conductive film with copper in a thickness of 50 μm with the previously formed pattern of resist as a molding form.

Subsequently, the entire substrate inclusive of the superposed film is immersed in hydrofluoric acid of high concentration to remove the masking materials 42 and 43, smooth the surface, and remove the silicone oxide film 45 from between the piston, movable electrodes, and silicon substrate as illustrated in FIG. 9C. As a result, the piston and the movable electrodes are rendered movable and the formation of the piston and the movable electrodes is completed.

Fabrication of check valve:

From another silicon substrate, a silicon substrate 31 having the opposite surfaces thereof furnished with a mirror polish and having a thickness of 200 μm is prepared. Silicon oxide films 42 are formed one each in a thickness of 0.5 μm by the thermal oxidation method on the opposite surfaces of the silicon substrate 31 and the portions of the silicon oxide film destined to form the valves proper in the subsequent step and the portion thereof destined to fix the arms of the valves on the silicon substrate are patterned by means of photolithography and removed by the RIE as illustrated in FIG. 10A.

Then, a PSG film 61 is formed in a thickness of about 0.8 μm by the normal-pressure CVD method as illustrated in FIG. 10B. The portions of the PSG film 61 destined to fix the arms of the valves on the silicon substrate are patterned and removed by means of photolithography.

Subsequently, a polysilicon film 62 is formed in a thickness of about 6 μm by the normal-pressure CVD method, patterned by photolithography, and etched by the RIE to form the valves proper and the parts for fixing the valves as illustrated in FIG. 10C.

Now, a polysilicon film 63 is formed in a thickness of about 2 μm by the normal-pressure CVD method, patterned by means of photolithography, and etched by the RIE to form the part of the arms of the valves as illustrated in FIG. 10D.

Then, silicon oxide films and silicon nitride films 64 are formed by the LP-CVD on the obverse surface (the surface on which the valve parts have been formed as described above) and the reverse surface to give rise to masking materials as illustrated in FIG. 10E. The portions of the silicon oxide film and silicon nitride film 64 destined to form a flow path on the reverse surface are removed and wet etched by the use of an aqueous solution containing potassium hydroxide at a concentration of about 35% by weight to give rise to a through hole intended as a flow path. In the micro-pump illustrated in FIG. 5 and FIG. 6, the same valves are formed two each on either surface.

Further, the process thus far described is performed on the other surface to form valves of polysilicon on the opposite surfaces of the silicon substrate.

Finally, the entire silicon substrate inclusive of the superposed films is immersed in hydrofluoric acid of a high concentration to effect complete removal of the silicon oxide films 24, PSG films 61, and silicon nitride films 64 and complete the process for the formation of the check valves.

Formation of micro-pump:

The two silicon substrates having pistons and valves formed thereon as described above are superposed on each other and joined fast to each other as illustrated in FIG. 4, and FIG. 6 to complete a micro-pump. In preparation of this face-to-face bonding of the substrates, glass films are deposited one each in a thickness in the range of from 2 to 3 μm on the lower surfaces of the silicon substrates 31 by the RF spattering method using a frit glass sheet (such as, for example, the product of Iwaki Glass Co., Ltd. marketed under trademark designation of "Crystallized Glass 7576") as a target. This spattering is carried out in an atmosphere of oxygen ($8\times10^{-3}$ Torr) so as to replenish the deposited glass with oxygen and preclude the otherwise possible shortage of oxygen supply. The parts which have formed the valves are covered with a resist to prevent the glass film from overlying the valves. Then, the two silicon substrates 11, or 31 and 12, or 32 are superposed on each other as accurately registered through the monitoring of the top-view patterns of the substrates projected through an infrared camera positioned on the lateral sides of the substrates. The two substrates are heated to a temperature in the range of from 150° to 170° C. and one of them is simultaneously subjected to application of a DC voltage of about 100 V to obtain the fast bonding.

The micro-pumps constructed as illustrated in FIGS. 3 to 6 are completed by the procedure described above.

In the micro-pump illustrated as one embodiment in FIG. 3 and FIG. 4, a depression with a depth of 50 μm is formed in part of a silicon substrate 12, namely the part covering an iron electrode 19. Formed integrally with a piston 14 and stationary electrode 16, as illustrated in FIG. 4 so as to prevent the motion of the piston from giving rise to negative pressure or positive pressure in empty spaces 17 and 18.

Also, in the micro-pump embodying this invention as illustrated in FIG. 5 and FIG. 6, the part of the silicon substrate 31 which covers the movable electrodes **39*a* and 39*b*, and the stationary electrodes 36*a* and 36*b* is formed in the shape of a depression of a depth of about 50 μm as illustrated in FIG. 6** so as to preclude the possibility of a negative pressure or positive pressure arising in the empty space which is produced between the stationary electrode and movable electrode by the motion of the movable electrode.

The number Of teeth of the combs of the movable electrodes **39*a* and 39*b* is set at 11 (only four teeth are shown in FIG. 5 for the sake of simplicity of drawing). The gap 40 between the stationary electrode and the movable electrode has a width of 1 μm. The micro-pump is driven by alternately applying a voltage of 100 V from an external source between the diffusion layer regions 36*a* and 36*b* and the diffusion terminal 41 which are connected to the conductive film 35**.

In the present working example, the conductive film 35 is used for the purpose of keeping the piston 34 and the movable electrodes **39*a* and 39*b* constantly at a grounding potential. For this reason, the conductive film 35 is vested with ample flexibility by being corrugated to an extent incapable of obstructing of motion of the piston 34**.

Further in the micro-pump of the present working example, the lengths K and M of the sealed parts are amply larger than the stroke of the piston so as to allow a sufficiently small conductance between the piston 34 and the cylinder **34*a* as compared with the normal direction conductance of the check valves 33*a*, 33*b*, 33*c*, and 33*d*. This difference in conductance enables the check valves 33*a*, 33*b*, 33*c*, and 33*d* to discharge and aspirate the fluid in accordance as the volumes of the fluid chambers 38***a* and 38*b* are changed by the motion of the piston.

The process of production described thus far completes a micro-pump measuring $1\times2\times4$ mm$^3$. The completed micro-pump has a discharge pressure of 4 gf/cm$^2$ and a flow volume of 0.18 μl/min.

What is claimed is:

1. A micro-pump comprising a cylinder, a piston housed within the cylinder for pressing a fluid, said piston having opposite end faces, an operating chamber formed between each of said end faces and ends of the cylinder, movable electrodes formed integrally with said piston, a conductive film disposed in said cylinder for grounding said piston and said movable electrodes, an inlet and an outlet check valve communicating with each operating chamber in said cylinder, and a drive source operatively associated with at least said piston for moving the piston back and forth so that the opposite end faces of said piston press the fluid and force it through the check valves in order to pump fluid.

2. A micro-pump according to claim 1, wherein said cylinder is formed between a first substrate having a depressed part formed in a surface thereof and a second substrate applied to a side of said first substrate where the depressed part is disposed.

3. A micro-pump according to claim 2, wherein said movable electrodes are disposed in the depressed part of said first substrate.

4. A micro-pump according to claim 2, including stationary electrodes disposed in the depressed part of the first substrate, and wherein said stationary electrodes and said movable electrodes are both formed in the shape of a combtooth.

5. A micro-pump according to claim 2, wherein said conductive film is disposed inside said depressed part and is held in contact with said piston.

6. A micro-pump according to claim 1, wherein said movable electrodes are formed adjacent the opposite end faces of said piston.

* * * * *

UNITED STATES PATENT AND TRADEMARK OFFICE

CERTIFICATE OF CORRECTION

PATENT NO. : 5,362,213

DATED : November 8, 1994

INVENTOR(S) : Kiyoshi KOMATSU et al

It is certified that error appears in the above-indentified patent and that said Letters Patent is hereby corrected as shown below:

In Column 1, line 7, delete "ant" and insert -- and --.

In Column 1, line 42, delete "Dower" and insert -- power --.

In Column 1, line 53, delete " " ".

In Column 1, line 68, delete "cheek" and insert -- check -- (both occurrences).

In Column 2, line 37, delete "having".

In Column 2, line 44, delete "cheek" and insert -- check --.

In Column 2, line 46, after "piston", insert -- to --.

In Column 2, line 67, delete "cheek" and insert -- check --.

In Column 3, line 45, delete "diagram" and insert -- diagrams --.

In Column 3, line 59, delete "cheek" and insert -- check --.

In Column 4, line 18, after "47 a" should read --4, a--.

In Column 4, line 60, delete "cheek" and insert -- check --.

In Column 4, line 63, delete "cheek" and insert -- check --.

In Column 5, line 3, delete "cheek" and insert -- check --.

In Column 5, line 35, delete "cheek" and insert -- check --

In Column 5, line 36, delete "cheek" and insert -- check --.

In Column 5, line 39, delete "Dump" and insert -- pump --.

In Column 5, line 64, delete "(1+2x)" and insert -- ($\ell$+2x) --.

In Column 5, line 67, delete "1" and insert -- $\ell$ --.

In Column 6, line 63, delete "cheek" and insert -- check --.

In Column 7, line 8, delete "adopted" and insert -- applied --.

In Column 7, line 14, delete "cheek" and insert -- check --.

UNITED STATES PATENT AND TRADEMARK OFFICE

CERTIFICATE OF CORRECTION

PATENT NO. : 5,362,213

DATED : November 8, 1994

INVENTOR(S) : Kiyoshi KOMATSU et al

It is certified that error appears in the above-indentified patent and that said Letters Patent is hereby corrected as shown below:

In Column 7, line 40, delete "information" and insert -- formation --.
In Column 8, line 41, after "layers", insert -- is --.
In Column 8, line 54, delete "alone" and insert -- along --.
In Column 10, line 6, delete "In" and insert -- in --.
In Column 11, line 24, delete "park" and insert -- part --.
In Column 12, line 8, delete "Is" and insert --as --.
In Column 14, line 44, delete "Of" and insert -- of --.
In Column 14, line 58, delete "of" (second occurrence) and insert -- the --.

Signed and Sealed this

Eighteenth Day of April, 1995

Bruce Lehman

*Attest:*

BRUCE LEHMAN

*Commissioner of Patents and Trademarks*

*Attesting Officer*